United States Patent [19]

Rehm et al.

[11] Patent Number: 4,663,900

[45] Date of Patent: May 12, 1987

[54] LOCKING MAST AND STOP RING ASSEMBLY

[75] Inventors: Roger P. Rehm, Orrville; William R. Trimmer, Wooster, both of Ohio

[73] Assignee: Singer Products Corporation, Smithville, Ohio

[21] Appl. No.: 809,504

[22] Filed: Dec. 16, 1985

[51] Int. Cl.[4] ..... B66C 23/06

[52] U.S. Cl. ..... 52/115; 52/118; 52/121; 52/632; 212/267

[58] Field of Search ..... 52/111, 113, 115, 121, 52/300, 301, 632, 726, 118; 212/267, 268, 269

[56] References Cited

U.S. PATENT DOCUMENTS

| | | | |
|---|---|---|---|
| 2,679,911 | 6/1954 | Bhend | 52/726 X |
| 2,708,493 | 5/1955 | Badertscher et al. | 189/26 |
| 3,135,363 | 6/1964 | Bourassa | 52/632 X |

FOREIGN PATENT DOCUMENTS

| | | | |
|---|---|---|---|
| 698218 | 11/1964 | Canada | 52/115 |

*Primary Examiner*—Carl D. Friedman
*Assistant Examiner*—Naoko N. Slack
*Attorney, Agent, or Firm*—Renner, Kenner, Greive, Bobak & Taylor

[57] ABSTRACT

A locking assembly (35) for telescoping masts (10) having at least first and second tubes (12,13), the second tube (13) fitting within the first tube (12). The assembly includes sleeve means (36) encompassing one end (59) of the second tube (13) and rigidly affixed thereto, cap means (58) affixed to the second tube (13) below the sleeve means (36) forming an air tight seal within the first tube (12), stop ring means (38) carried above the sleeve means (36) and encompassing the second tube (13), recess means (68) formed by the sleeve means (36) and the stop ring means (38) and locking collar means (20) rigidly affixed to a first end (43) of the first tube (12) providing at least one movable member (76) engageable with the recess means (68).

38 Claims, 6 Drawing Figures

41
42
13
35
3
3
92
54
20
49
38
70
76
71
82
82
78
90
92
84
49
48
90
43
84
19
39
40
12
36
11
44
58
56
65
62
61
12

LOCKING MAST AND STOP RING ASSEMBLY

TECHNICAL FIELD

The present invention is applicable to telescoping masts which serve as antennae or as a support for antennae, floodlights and the like. The use of such masts for broadcasting and receiving radio frequencies is of particular importance to the military where it is often necessary that the structure be portable. Portable, temporary lighting is also required in civilian operations that occur at night ranging from emergency to work support and to recreational. The mast is extended by air power and can be of two types, non-locking or locking depending upon whether the mast is supported constantly by air or air is utilized only for extending and lowering and the mast is then maintained erect by mechanical means. The present invention provides a novel mechanical locking assembly for the latter.

BACKGROUND ART

Locking mast assemblies are provided with a plurality of telescoping tubes beginning with a first, outer tube that receives pressurized air through the base and which is open at the top where an inner, concentric tube is located. This inner tube allows for the passage of air through its base and into additional tubes that are provided in order to obtain a desired height when the mast is fully extended. The last, innermost tube is sealed at the bottom to contain air which allows the mast to be extended as air is added.

Each tube is provided with a locking collar that maintains an adjacent inner tube in the extended position so that the air pressure supply can be removed. Such locking assemblies are known and commonly introduce one or more locking pins circumferentially around the base area of an inner extended tube to engage recesses, grooves, keys and the like.

In order to maintain the portability of the telescoping mast, particularly mobility from location to location and ease of raising and lowering, it is desirably constructed of light weight metal such as aircraft aluminum. Although the mast is not exceedingly heavy, it is necessary to employ a locking pin of greater strength such as steel and preferably stainless steel so that the pin is not sheared or prematurely weared. However, supporting the weight of distal segments by pins alone which are, in turn, in mating engagement with aluminum will cause deformation of the aluminum via bending, peening, even tearing, such that the mast may not fully extend, it may be subject to undue axial rotation and in either event extension and lowering can become impaired eventually leading to failure of the mast.

Possible solutions to this problem have involved reinforcement of the pin engaging area by compatible metal such as steel. Nevertheless, this gives rise to a new set of problems because of the difficulty of affixing the reinforcements to the aluminum tubes. Factors to be considered are that the telescoping engagement must not be impaired, i.e., the reinforcement must fit within a concentric lower tube of greater diameter and, the pneumatic integrity must not be breached. Welding the reinforcement to the tube affixes the two together well but weakens the tube which can lead to failure of the assembly. Tack welds, coupled with the use of adhesives, avoids weakening the tube but these can fail.

One early patent of which we are aware, U.S. Pat. No. 2,708,493, is directed toward a portable antenna mast that can be raised hydraulically and which carries a locking assembly. The latter employs a stop collar affixed to the outboard end of a telescoping inner tube section and spring-biased plungers that are positioned as soon as the stop collar passes thereover.

Thus, despite the fact that a variety of locking pin arrangements have been developed, the problems discussed hereinabove as well as others, have not been satisfactorily eliminated until now.

DISCLOSURE OF THE INVENTION

It is therefore an object of the present invention to provide a new assembly for locking telescoping sections of masts in the extended position.

It is another object of the present invention to provide such an assembly, providing a pin engaging area of stronger metal than the telescoping section, such as where the section is aluminum, but which does not rely upon welding or adhesives in the pin engaging area.

It is yet another object of the present invention to provide an assembly for locking that is relatively inexpensive, does not require extensive machining and is designed to operate with existing locking collars, thereby eliminating the necessity to alter the manufacturing process.

It is still another object of the present invention to provide an assembly that provides the greatest strength, through welding, but does so in an area of the telescoping section away from the point of greatest bending moment when that section is in extended position.

These and other objects, together with the advantages thereof over known locking assemblies, which shall become apparent from the specification which follows, are accomplished by the invention as hereinafter described and claimed.

In general, the locking assembly of the present invention is utilized in conjunction with at least two sections, the first or outer tube and a second constituting an inner tube that fits within the outer tube and is movable axially therewith. The assembly includes sleeve means encompassing one end of the second tube and rigidly affixed thereto; cap means affixed to the second tube below the sleeve means for forming an air tight seal within the first tube; stop ring means connected to and carried above the sleeve means and encompassing the second tube; recess means, formed by the sleeve and stop ring means; and locking collar means rigidly affixed to one end of the first tube providing at least one movable member engageable with the recess means.

More generally, the locking assembly of the present invention is applicable to telescoping masts having a plurality of telescoping, concentric tube sections, one of which defines an outermost tube section, receiving all of the other tube sections, one of which is an innermost tube section, and the remaining tube sections are concentrically arranged with varying diameters between those of the outermost and innermost tube sections, each said tube section having an inboard and an outboard end. The assembly comprises a plurality of sleeve means, one for each tube section except the outermost section, encompassing the inboard end of the tube sections and rigidly affixed thereto; a plurality of cap means, affixed to each tube section, except the outermost section, forming an air tight seal between concentric tube sections; a plurality of stop ring means, one carried above each sleeve means and encompassing the tube section; a plurality of recess means formed by each sleeve means and each stop ring means; and, a plurality of locking collar means rigidly affixed to the outboard end of each tube section except the innermost section and providing at least one movable member engageable with the recess means.

PREFERRED EMBODIMENT FOR CARRYING OUT THE INVENTION

Figure 1:
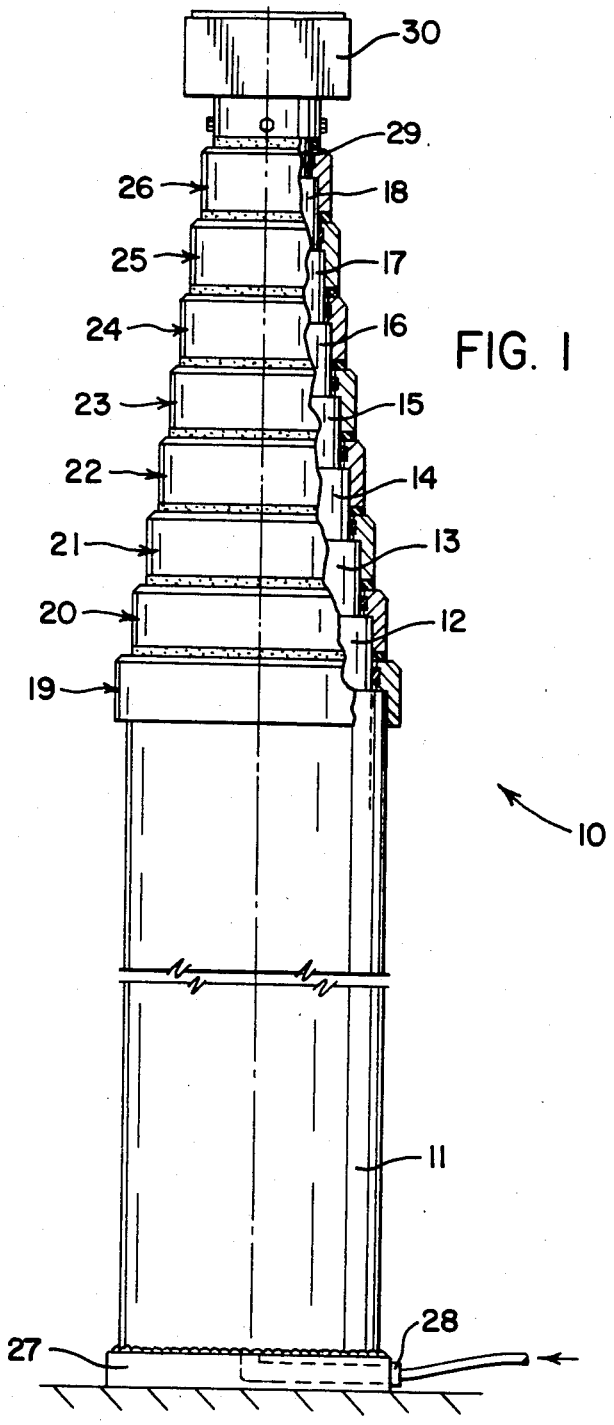
FIG. 1 is an overall elevation of a telescoping mast assembly, in nested position, of a type for which the present invention can be employed.

A telescoping mast with which the present invention is applicable is depicted in FIG. 1 in the lowered position. The mast, indicated generally by the numeral 10, comprises a plurality of telescoping tube sections, beginning with a bottom section 11, and concentrically smaller sections 12–18, each with a locking collar 19–26, respectively. While nine tube sections have been depicted, the invention is applicable with as few as two sections or as many as may be necessary to provide a desired extended height with a minimal overall nested length.

The bottom or outermost section is provided with a base 27 which provides the platform upon which the mast is erected. The base 27 carries an inlet 28 for coupling with a source of compressed air, not shown, that is used to operate the mast, i.e., raise and lower. At the upper end of the mast 10, an innermost tube section 29 is provided which carries the work platform 30 upon which radio equipment, floodlights or other equipment is mounted. Power is carried to the work platform 30 in customary fashion and need not be discussed here. Each of the locking collars carries at least one locking pin, detailed hereinbelow and a manual pin releasing means, such as a lanyard (not shown).

Recalling the overall structure depicted in Fig. 1, it should be noted that each tube section except the innermost is provided with a locking collar which will, in turn, support the next contiguous tube nested therein. Also, while the outermost tube 11 is the outer tube for the next tube, tube 12 is both an inner tube as to tube 11 and an outer tube as to tube 13 and so forth. Thus, although a plurality of tubes 11–18 and 29 and collars 19–26 have been referenced in FIG. 1, for purposes of detailing the relationship between two contiguous tubes and a collar in the overall mast, tubes 12 and 13 and collar 20 shall be described with the understanding that the description is applicable to the other tube pairs depicted.

Figure 2:
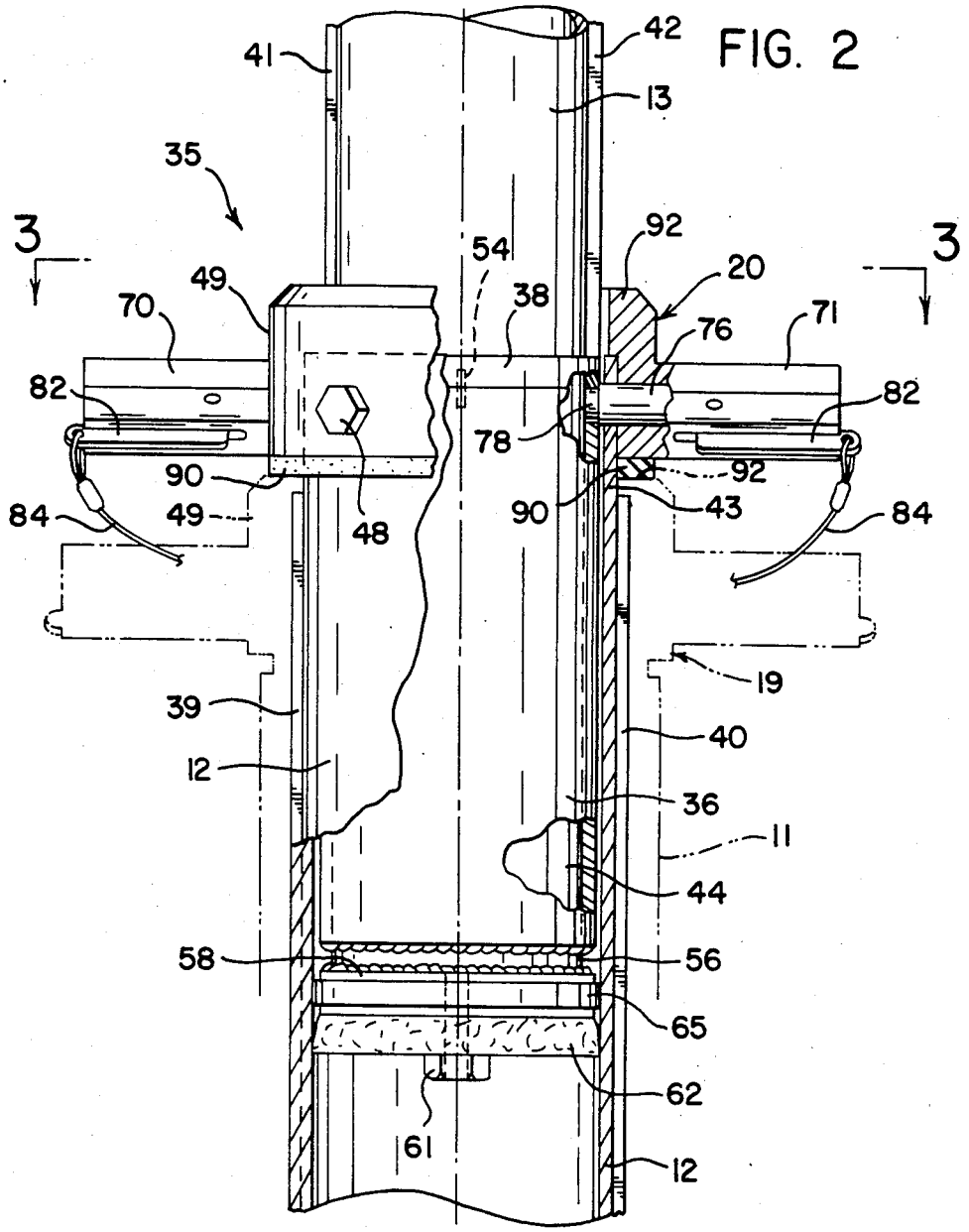
FIG. 2 is a side elevation, partially in section, depicting the locking assembly of the present invention and in particular the relation of the inner and outer tubes in extended locking position.

With reference to FIG. 2, the locking assembly of the present invention shall also be described. The locking assembly, referred to generally by the numeral 35, comprises a locking collar, e.g., 20, which is carried at one end of a first or outer tube, e.g., 12, and a sleeve 36 and stop ring 38 carried at one end of a second or inner tube, e.g., 13. Where the mast includes a plurality of tube sections, all sections except the innermost carry a locking collar while the sleeve and stop ring are provided on all tube sections except the outermost.

Each tube 12 and 13 is extruded from a lightweight, preferably inexpensive metal such as aircraft aluminum, and is provided with two external keys 39, 40 and 41, 42 respectively. Each tube has two ends one which can be thought of an inboard and the other as outboard, outboard being in the direction of extension. While tubes 12 and 13 each have these ends, it must be noted that an outer tube, such as 12 is to 13, is at the same time an inner tube to a larger lower tube such as tube 11. Similarly, the inner tube 13 described herein is also an outer tube to tube 14 carried therein. Apart from that recognition, outer tube 12 has an outboard end 43, depicted in the drawings and an inner end not numbered and, inner tube has an inboard end 44, depicted in the drawings and an outer end not numbered.

The sleeve 36 is also manufactured from aircraft aluminum and is readily welded to the inner tube 13 as discussed hereinbelow. Stop ring 38 preferably comprises a higher strength metal such as stainless steel.

Figure 4:
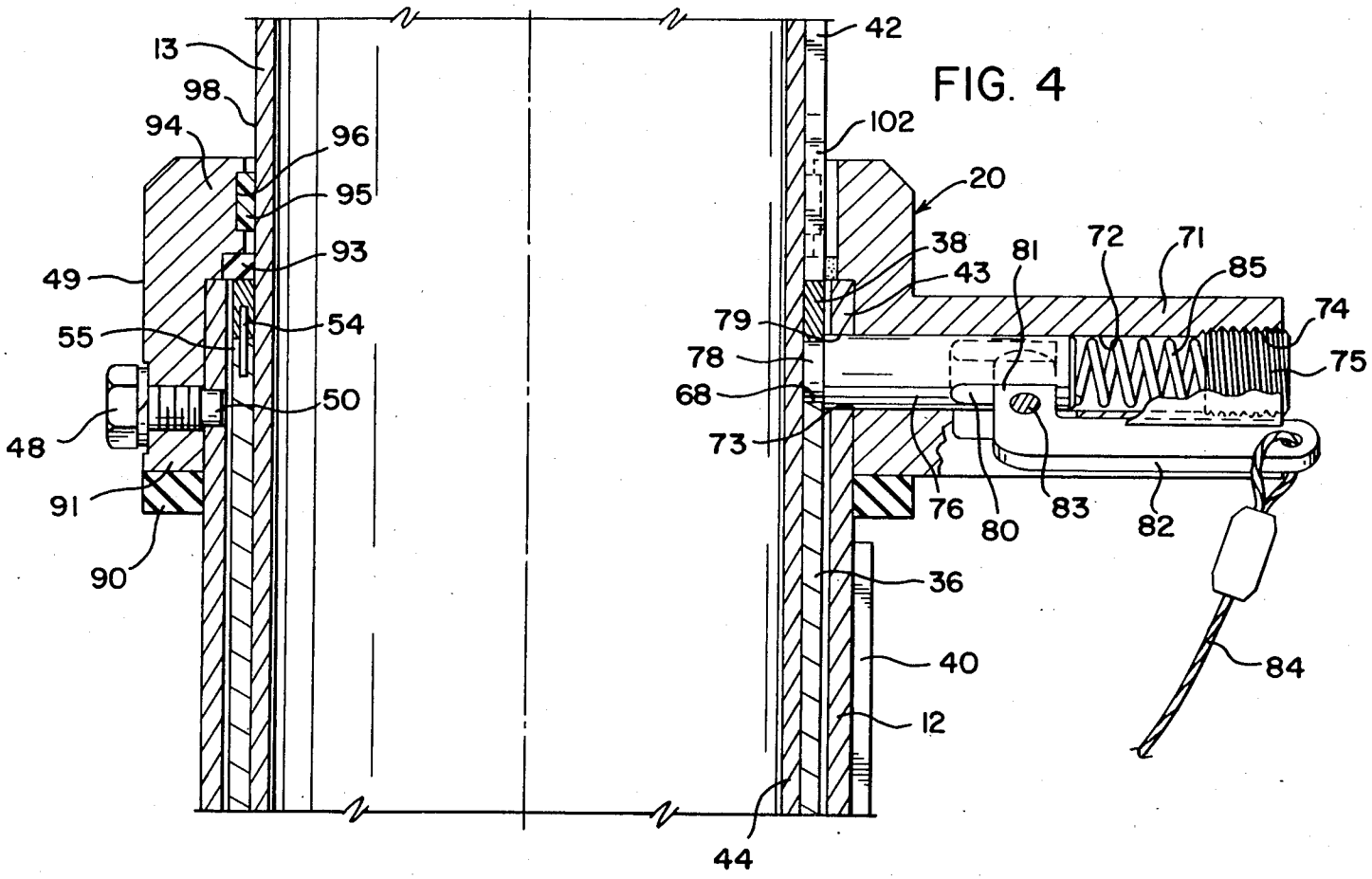
FIG. 4 is an enlarged side elevation, taken substantially along the line 4—4 in FIG. 3 and partially in section, of a collar and its component parts.

In order to mount the locking collar 20 to the outboard or upper end 43 of outer tube 12 the keys 39 and 40 are machined off and the collar is affixed via bolts 48 which pass through the collar sleeve 49 and into the tube wall as at 50 (FIG. 4). The keys 41 and 42 are also machined away from the inboard end 44 of the inner tube 13 a distance slightly in excess of the height of sleeve 36 and stop ring 38. The latter two are dimensioned closely to the outer diameter of tube 13 so as to fit snuggly thereon and are fastened axially together with roll pins 54 which are received in the outboard end 55 of sleeve 36. As noted in FIG. 6, the ring 38 and sleeve 36 are slid tightly against the machined end of key 42 and correspondingly against key 41, not shown, leaving a span of the tube 13 uncovered at 56. A base plate 58 is affixed to the tube 13 and it and the inboard end 59 of sleeve 36 are welded circumferentially to the tube 13 at 56.

Figure 5:
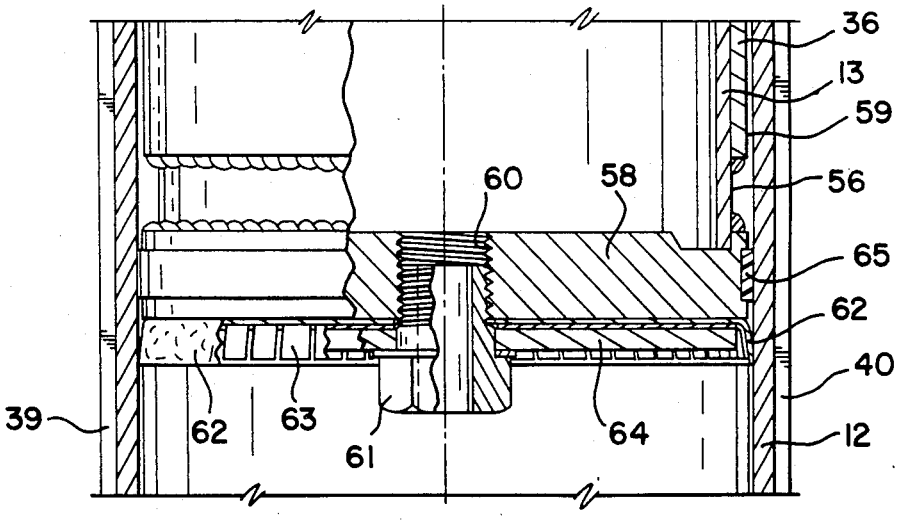
FIG. 5 is an enlarged side elevation, partially in section, of the end of an inner tube that remains within the outer tube of a mast assembly.

With reference to FIG. 5, base plate 58 is provided with a threaded bore 60 which receives an orifice bolt 61 that allows for the passage of air into and through the tube 13. The bolt 61 also affixes a leather seal 62, metal expander ring 63 and back up washer 64 to the plate 58, as depicted in FIG. 5 which forms a seal at the base of tube 13 allowing it to rise within outer tube 12 under air pressure. In order for all of the nested tubes to move by compressed air, the uppermost tube, e.g., 29 can be provided with a solid bolt in lieu of orifice bolt 61 or the plate bore 60 can be capped or otherwise plugged thereby sealing a column of air within the mast 10. The base plate 58 can also be provided with a circumferential groove for receipt of a bearing 65 comprising a suitable material such as nylon.

It is to be understood that the specific sealing arrangement thus described is not a feature of the present invention and is therefore not a restriction. As will be appreciated by those skilled in the art, other means can be substituted therefor. What is important to the present invention, however, is that the sleeve 36 is affixed to the tube 13 at 56 in the manner described. The sleeve strengthens the tube 13 by effectively doubling the wall thickness in the area of the bending moment and yet the weld is sufficiently distal from the point of greatest stress that the metal is not weakened. Moreover, the stop ring 38 is rigidly affixed to the tube 13 without direct welding.

It will also be noted that the sleeve is provided with two notches in axial alignment with the keys 41 and 42, one notch 66 being visible in the drawings, the other being 180° therefrom and not shown. Together the notch 66 and retaining ring 38 provide a recess 68 for location of a latch pin from collar 20.

With reference next to FIG. 4, a typical latch pin locking collar assembly shall be described. The assembly, indicated generally by the numeral 20, includes the bearing collar 49 referenced hereinabove and left and right extensions, 70 and 71, respectively, which protrude from the collar and are spaced 180° from each other. Both are identical and therefore with reference to FIG. 4, the extension 71 shall be described in detail.

Extension 71 is provided with a radial bore 72 which passes through the collar 20, opening at 73. The outermost end is threaded, at 74, for receipt of a spring retaining screw 75. Housed within bore 72, is the latch pin 76 the end 78 of which passes through a bore 79 in outer tube 12 and is engageable with recess 68. At the opposite end, the pin is provided with an elongate slot 80 which receives the short leg 81 of a pin release key 82. The key 82 is pivotally affixed to the extension 71 as with a roll pin 83. The key 82 is connected to a lanyard cable 84 at its opposite end and during operation it can be seen that by pulling the lanyard, the key pivots pulling latch pin 76 away from the tubes 12 and 13 sufficiently for the end 78 to disengage the recess 68. A spring 85 biases the pin 76 toward the recess 68 when the lanyard is released.

At this point it should also be noted that the present invention is not to be limited to the particular locking collar assembly 20 thus far described. So long as a movable pin can be supported by an outer tube to engage the recess 68, the mast 10 can be extended and mechanically locked so that the air supply can be removed.

The collar 49 is also provided with an external bumper 90 at its base or bottom 91 which is engageable with the top 92 of a lower collar when the tube sections are nested (FIG. 2). An internal bumper 93 is also carried by the collar 49 in the upper flange 94 thereof which acts as a stop when the inner tube 13 and stop ring 38 are fully extended, as depicted in FIG. 4. Finally a bearing 95 is placed in a circumferential groove 96 of flange 94 which engages the exterior surface 98 of tube 13.

Figure 3:
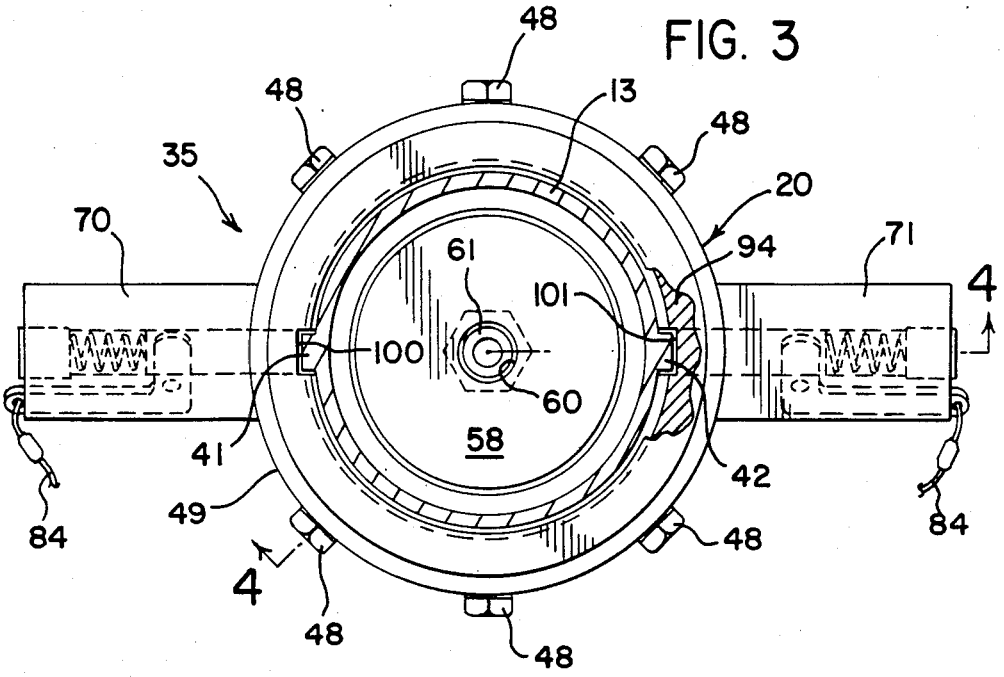
FIG. 3 is a top plan view of the locking collar assembly taken substantially along the line 3—3 in FIG. 2.
Figure 6:
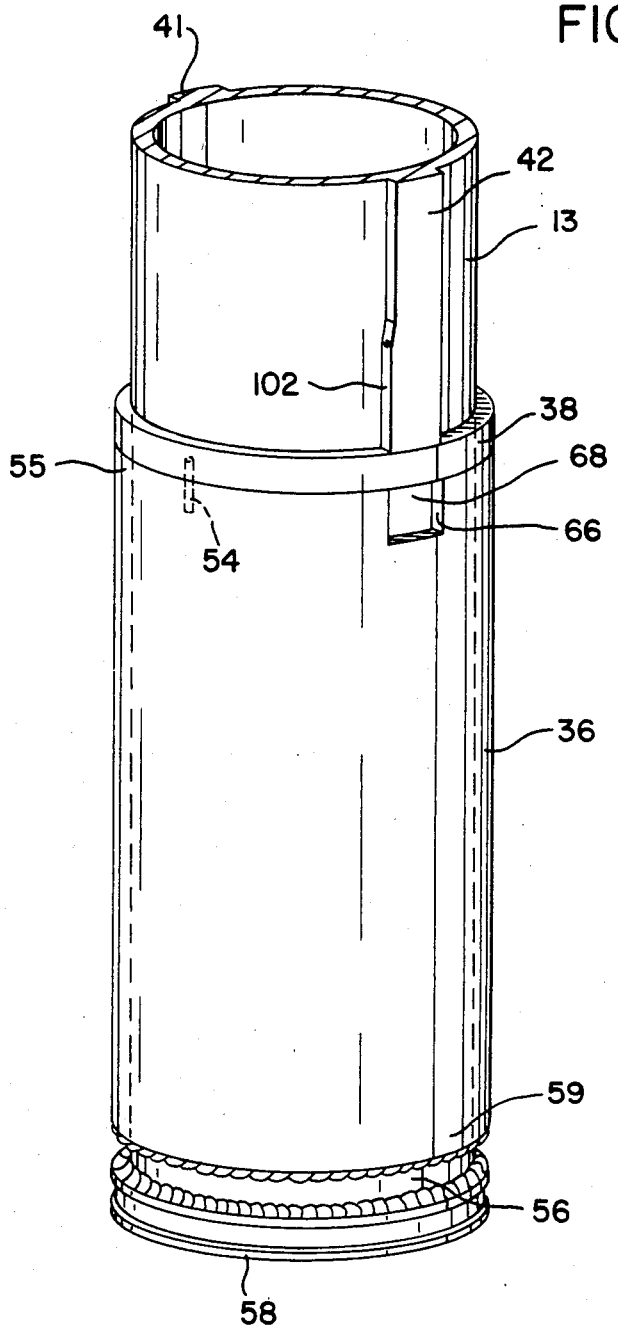
FIG. 6 is a perspective view of a telescoping inner tube depicting the basic components of the present invention which are carried within an outer tube of a mast assembly.

With reference next to FIG. 3, it will be noted that the upper flange 94 of collar 49 is interrupted by axially extending notches 100 and 101 that are radially aligned with extensions 70 and 71, respectively. These notches are engageable with the keys 41 and 42 of the inner tube 13 and, inasmuch as the collar is rigidly affixed to outer tube 12, the rotation of inner tube 13 during extension and lowering is thereby controlled. Preferably the notches 100 and 101 are slightly wider than the width of the respective keys so as not to cause undue wear of the latter during use. Also, the tubes may be anodized and this design will minimize the removal of the anodizing. In order for the tube 13 to be essentially non-rotatable when it is fully extended, the keys can be built up with weld 102 immediately above stop ring 38, as depicted in FIG. 6 for the key 42.

As should be evident from the foregoing description, the locking assembly 35 of the present invention can be manufactured and installed on each of the tubes without a great deal of labor or additional, costly materials. Although a cost savings should be reflected over existing locking collar designs, the present assembly provides a stronger more fail-safe means of mechanically locking telescoping masts.

Based upon the foregoing disclosure, it should now be apparent that the use of the assembly described herein will carry out the objects set forth hereinabove. It should also be apparent to those skilled in the art that the locking assembly of the subject invention can readily be utilized with modified mast structures as may employ fewer or greater keys, different locking collars, different sealing and bearing arrangements and so forth. It is to be understood that an variations evident fall within the scope of the claimed invention; therefore, the selection of specific materials and component elements can be determined without departing from the spirit of the invention herein disclosed and described. Moreover, the scope of the invention shall include all modifications and variations that may fall within the scope of the attached claims.

We claim:

1. A locking assembly for telescoping masts having at least first and second tubes, said second tube fitting within said first tube and movable axially with respect thereto, comprising:

sleeve means having first and second ends and encompassing one end of said second tube and rigidly affixed at said first end;

cap means affixed to said second tube below said sleeve means forming an air tight seal within said first tube;

stop ring means carried above said sleeve means in contact with said second end and encompassing said second tube;

recess means formed by said sleeve means and said stop ring means; and, locking collar means rigidly affixed to a first end of said first tube providing at least one movable member engageable with said recess means.

2. A locking assembly, as set forth in claim 1, wherein said sleeve means comprises a section of tube substantially shorter than said first and second tube and which is slidable with the second tube within said first tube.

3. A locking assembly, as set forth in claim 2, wherein said sleeve means and said stop ring means remain in said first tube when said second tube is fully extended

4. A locking assembly, as set forth in claim 3, wherein a first end of said sleeve means is secured to said second tube a short distance from a first end thereof.

5. A locking assembly, as set forth in claim 4, wherein said second tube carries at least one external key.

6. A locking assembly, as set forth in claim 5, wherein said key is removed from the area encompassed by said sleeve means and stop ring means

7. A locking assembly, as set forth in claim 6, wherein said locking collar means carries an internal axial groove engageable with said key.

8. A locking assembly, as set forth in claim 7, wherein said recess means comprises a notch provided at a second end of said sleeve means open to said stop ring means.

9. A locking assembly, as set forth in claim 8, wherein said recess means is colinear with said external key.

10. A locking assembly, as set forth in claim 8, wherein said second tube carries a second external key; said locking collar means carries a second internal axial groove engageable with said second key; and said recess means includes a second notch provided at said second end of said sleeve means.

11. A locking assembly, as set forth in claim 10, wherein said second notch is colinear with said second key.

12. A locking assembly, as set forth in claim 1, wherein said second tube carries at least one external key.

13. A locking assembly, as set forth in claim 12, wherein said key is removed from the area encompassed by said sleeve means and stop ring means.

14. A locking assembly, as set forth in claim 13, wherein said locking collar means carries an internal axial groove engageable with said key.

15. A locking assembly, as set forth in claim 14, wherein said recess means comprises a notch provided at a second end of said sleeve means open to said stop ring means.

16. A locking assembly, as set forth in claim 15, wherein said recess means is colinear with said external key.

17. A locking assembly, as set forth in claim 15, wherein said second tube carries a second external key; said locking collar means carries a second internal axial groove engageable with said second key; said recess means includes a second notch provided at said second end of said sleeve means; and said locking collar means provides a second movable member engageable with said second notch.

18. A locking assembly, as set forth in claim 17, wherein said second notch is colinear with said second key.

19. A locking assembly, as set forth in claim 1, wherein said recess means comprises a notch provided at one end of said sleeve means open to said stop ring means.

20. A locking assembly, as set forth in claim 1, wherein said sleeve means and said stop ring means are connected together.

21. A locking assembly, as set forth in claim 20, wherein said sleeve means and said stop ring means comprise different materials.

22. A locking assembly, as set forth in claim 1, wherein said movable member comprises a pin movable through a mating bore in said first tube.

23. A locking assembly, as set forth in claim 1, further comprising:

a third tube fitting within said second tube and movable axially with respect thereto;

second sleeve means encompassing one end of said third tube and rigidly affixed thereto;

second cap means affixed to said third tube below said second sleeve means forming an air tight seal within said second tube;

second stop ring means carried above said second sleeve means and encompassing said third tube;

second recess means formed by said second sleeve means and said second stop ring means; and second locking collar means rigidly affixed to said second tube means providing at least one movable member engageable with said second recess means.

24. A locking assembly for telescoping masts having a plurality of telescoping concentric tube sections, one of which defines an outermost tube section, receiving all of the other tube sections, one of which is an innermost tube section, the remaining tube sections being concentrically arranged and having varying diameters between those of the outermost and innermost tube sections, each said tube section having an inboard and an outboard end, said assembly comprising:

a plurality of sleeve means, one for each tube section except said outermost section, encompassing said inboard end of said tube sections, having first and second ends and rigidly affixed at said first end;

a plurality of cap means, affixed to each tube section, except said outermost section, forming an air tight seal between concentric tube sections;

a plurality of stop ring means, one carried above each said sleeve means and in contact with said second end and encompassing said tube section;

a plurality of recess means formed by each said sleeve means and each said stop ring means; and, a plurality of locking collar means rigidly affixed to the outboard end of each tube section except said innermost section and providing at least one movable member engageable with said recess means.

25. A locking assembly, as set forth in claim 24, wherein each said sleeve means comprises a section of tube substantially shorter than said tube sections and which is slidable with the tube section to which it is affixed within a mating tube section of concentrically greater diameter.

26. A locking assembly, as set forth in claim 25, wherein each said sleeve means and each said stop ring means remain in a tube section when the mating tube of concentrically lesser diameter is fully extended.

27. A locking assembly, as set forth in claim 26, wherein a first end of said sleeve means is secured to said tube section a short distance from the inboard end thereof.

28. A locking assembly, as set forth in claim 27, wherein each said tube section except said outermost carries at least one external key.

29. A locking assembly, as set forth in claim 28, wherein said key is removed from the area encompassed by said each sleeve means and each said stop ring means.

30. A locking assembly, as set forth in claim 29, wherein each said locking collar means carries an internal axial groove engageable with said key.

31. A locking assembly, as set forth in claim 30, wherein each said recess means comprises a notch provided at the outboard end of each said sleeve means open to each said stop ring means.

32. A locking assembly, as set forth in claim 31, wherein each said recess means is colinear with said external key.

33. A locking assembly, as set forth in claim 31, wherein each said tube section except said outermost carries a second external key; each said locking collar means carries a second internal axial groove engageable with said second key; each said recess means includes a second notch provided at said outboard end of each said sleeve means; and each said locking collar means provides a second movable member engageable with said second notch.

34. A locking assembly, as set forth in claim 33, wherein said second notch is colinear with said second key.

35. A locking assembly, as set forth in claim 24, wherein each said sleeve means and each said stop ring means are connected together in pairs.

36. A locking assembly, as set forth in claim 24, wherein each said movable member comprises a pin movable through a mating bore in said tube section carrying said locking collar means.

37. A locking assembly, as set forth in claim 24, wherein said outermost tube section communicates with a supply of air for raising and lowering said telescoping concentric tube section.

38. A locking assembly, as set forth in claim 37, wherein each said cap means except the one affixed to said innermost tube section contains an orifice for the passage of air, said cap means on said innermost tube being sealed to air flow whereby upon receipt of air through said outermost tube section each concentrically inner tube section is extended.

* * * * *